United States Patent [19]

Allamanche

[11] Patent Number: 5,050,409

[45] Date of Patent: Sep. 24, 1991

[54] METHOD AND APPARATUS FOR HANDLING SKINS OR HIDES

[76] Inventor: Roger Allamanche, Les Mésanges 3, Rue Joseph Grenouillet, 38780 Pont Eveque, France

[21] Appl. No.: 432,490

[22] Filed: Nov. 7, 1989

[30] Foreign Application Priority Data

Nov. 7, 1988 [FR] France ..... 88 15187

[51] Int. Cl.[5] ..... C14B 1/02; C14B 1/58; C14C 15/00

[52] U.S. Cl. ..... 69/33; 69/21

[58] Field of Search ..... 69/21, 22, 23, 33, 35, 69/47

[56] References Cited

U.S. PATENT DOCUMENTS 1,682,356 8/1928 Solomon ..... 69/47
4,040,278 8/1977 Zimmerman et al. ..... 69/21 X

FOREIGN PATENT DOCUMENTS 44898 2/1982 European Pat. Off. ..... 69/21
198777 10/1986 European Pat. Off. ..... 69/33
2407665 8/1975 Fed. Rep. of Germany .
2711647 9/1978 Fed. Rep. of Germany ..... 69/33
2384025 11/1978 France ..... 69/21
1280013 12/1986 U.S.S.R. ..... 69/27

*Primary Examiner*—Wm. Carter Reynolds
*Attorney, Agent, or Firm*—Bacon & Thomas

[57] ABSTRACT

A method of handling skins or hides having a central line of increased thickness along the back of the skin or hide between a tail end portion and a front end portion comprises displacing the skin or hide to a workstation by means of two clamping pincers on a handling apparatus, in accordance with the following sequence of steps: the skin or hide is engaged at its tail and front portions by the pincers; the pincers are moved away from each other in order to put the skin or hide under tension along the backline of the hide; the skin or hide is raised so as to allow it to fold along the backline while it hangs freely; the skin or hide is then displaced to a workstation while hanging in the folded position; the folded skin or hide is then laid out flat under tension on a reception plane at the workstation; and the pincers are released from the tail and front portions of the skin or hide.

17 Claims, 6 Drawing Sheets

METHOD AND APPARATUS FOR HANDLING SKINS OR HIDES

The present invention relates to handling skins or hides whether treated or otherwise, and taken mainly from mammals such as horse, cattle, sheep, or goats. The term "handling" is used in a general sense.

BACKGROUND OF THE INVENTION

After being removed from the body of the animal, a skin has one side called the "hair side", and its other side is called the "flesh side" and retains residues of flesh and fat together with numerous blood vessels. Such raw skins which are non-negligible in size and weight need to be subjected to various treatment operations during which numerous manipulations are necessary before they are transformed into leather.

One of these operations concerns treatment methods intended to conserve the skins, and the most commonly used technique is that of salting a stack of raw skins.

After the skins have been roughly cleaned on the flesh side, this salting technique consists in stacking the skins flat, flesh side up, and salting the flesh side of each skin prior to laying the next skin on top of it. This technique gives rise to stacks of skins that may be 1 meter (m) to 1.50 m high, which stacks are conserved in this state for the length of time required to dehydrate the skins so as to prevent or stop the development of microbes.

Experience shows that the conditions under which skins are salted and stored have a very large influence on the state of the conserved skins. Thus, during conservation, numerous well-known blemishes may occur such as pitting of the flesh side or the grain side, red or violet spotting, sweating, and/or arbor-escences. These blemishes or defects all have repercussions on the quality and appearance of the resulting leather.

It appears that salting and storage are not always performed under the best possible conditions, particularly insofar as these operations can be difficult for the handling personnel whose job it is to make up the stacks. The skins must be unfolded completely to lay them out flat giving rise to awkward and wearisome manual handling opertions because of the size, the weight, and the greasy nature of the skins, and also because of the heights of the stacks to be built up.

Another skin treatment operation, likewise requiring handling operations, concerns the technique of cropping. This operation consists, after the salt covering the skins has been removed, in cutting up each skin into four parts, namely the butt, the shoulder, and two belly parts. To this end, the handling personnel need to grasp the skins and shake them in order to remove the salt from the skins. Thereafter, the personnel fold each skin along the line of greatest back thickness corresponding to the portion of the skin that overlayed the spinal column of the animals, so as to enable both belly portions of the skin to be cut off simultaneously.

It is clear that taking hold of, grasping, and folding skins constitute operations which are difficult and wearisome for skin-handling personnel given the size, the weight, and the slippery nature of skins. In addition, it is difficult to fold skins in two along the line of greatest back thickness, and if the folding is poorly done, subsequent cutting will be inaccurate and erroneous relative to the portions of the skins thus obtaining portions of leather that are not uniform in structure.

When the two treatment operations described by way of example are analyzed, it can be seen how manipulation operations have an effect on the appearance of the final leather. There therefore appears to be a need for means for handling skins or hides in the various treatment operations to which the skins or hides are subjected, with "treatment" being taken in a general sense.

German patent application DE-A-24 07 665 describes an apparatus for handling skins prior to an exchange operation. The apparatus described includes two pincers each connected to a cable which is intended to be wound onto a drum whose rotation is controlled. The pincers are intended to hold the skin by its legs.

Although using such an apparatus provides a degree of help for the personnel handling skins, practice shows that such apparatus is unsuitable for spreading skins out completely flat insofar as the skins are handled via their leg portions. The problems relating to the salting technique therefore remain intact. In addition, the apparatus is not at all well adapted to the cropping technique.

The object of the present invention is therefore to provide a novel method suitable for handling skins or hides during various treatment operations while relieving handling personnel from the various constraints they are subject to and eliminating the causes of skin or hide deterioration.

The invention seeks to provide a method of storing skins in stacks which is suitable for limiting blemishes or defects due to storage.

SUMMARY OF THE INVENTION

To achieve these objects, the present invention provides a method of handling skins or hides having a central line of increased thickness along the back between a tail end portion and a front end portion, the method being of the type consisting in displacing the skin or hide to a workstation by means of two clamping pincers on a handling apparatus, the method comprising the following steps:

engaging the pincers on the tail and front portions of a skin or hide;

moving the pincers away from each other in order to put the skin or hide under tension along the back line of increased thickness;

raising skin or hide so as to allow it to fold along said back line of increased thickness while hanging freely;

displacing the skin or hide to the workstation while the skin or hide is hanging in the folded position;

laying the folded skin or hide out flat under tension on a reception plane at the workstation; and releasing the pincers from the tail and front portions of the skin or hide.

The invention also seeks to provide handling apparatus suitable, in particular, for implementing the techniques of salting and cropping stacked skins.

The invention also seeks to provide a handling apparatus which is simple in design and low in cost.

In order to implement the method, the present invention provides apparatus comprising two slings each fitted with a pincer for clamping across the thickness of a skin or hide, two spreader means for spreading the slings apart from each other in at least one substantially horizontally plane, and at least one motor unit acting on at least one of the slings in order to cause the pincers to move apart relative to each other;

wherein the spreader means are suitable for being spread apart from each other by a distance which is not less than the length of a skin or hide, thereby enabling the skin or hide clamped between the pincers to be folded and suspended along its back line of increased thickness, and wherein the motor unit is controlled to ensure that the pincers are spread apart by at least the length of a skin or hide, thereby enabling the skin or hide to be put under tension along its back line of increased thickness.

BRIEF DESCRIPTION OF THE DRAWINGS

An embodiment of the invention is described by way of example with reference to the accompanying drawings, in which.

DETAILED DESCRIPTION

Figure 1:
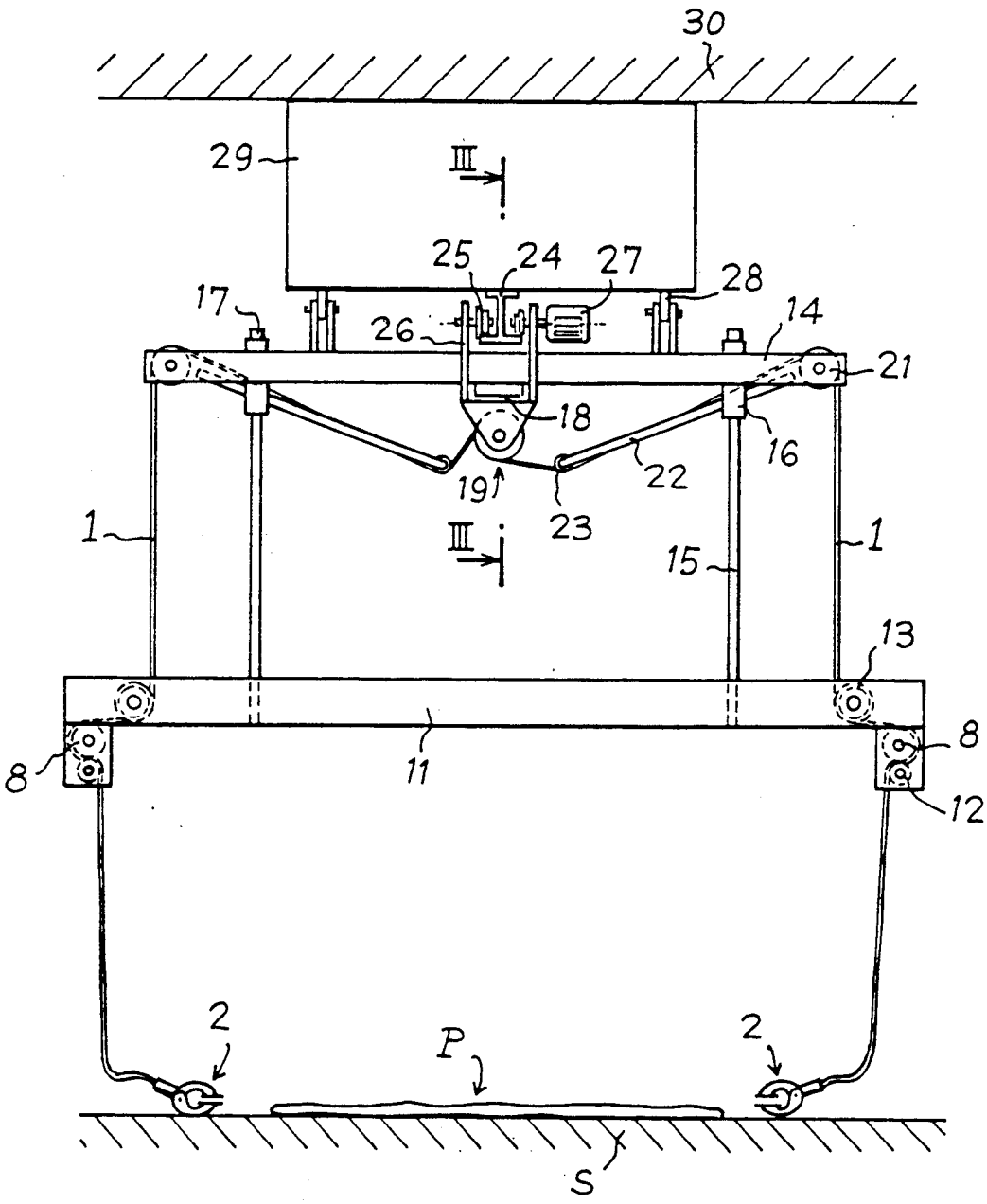
FIG. 1 is an elevation view of handling apparatus in accordance with the invention.

FIG. 1 shows an embodiment of an apparatus for implementing the skin or hide handling method of the invention, in various treatment operations for transforming raw skins into leather. The skins and hides used are mainly those of mammals, and in particular mammals in the horse, cattle, sheep, or goat families.

Figure 2:
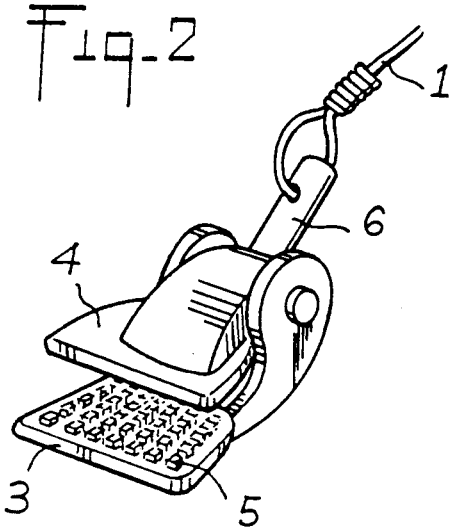
FIG. 2 is a detailed view of a pincer.

The apparatus of the invention includes two slings or cables 1 made of any suitable material and each fitted with a pincer 2 at one of its ends for clamping across the thickness of a skin or hide P, e.g. lying on the ground S. As can be seen more clearly in FIG. 2, each pincer 2 comprises two jaws 3 and 4 which are hinged together and each having a clamping surface which is preferably shaped to include projecting studs 5. The jaws 3 and 4 are urged towards each other by a resilient member (not shown) for exerting a determined force in order to grip a skin without damaging the resulting leather. One of the jaws, e.g. the jaw 5, is provided with a lever 6 for fixing to a sling, and the opening of the pincer can be locked in position, e.g. by means of a resilient bead co-operating with a complementary cavity (not shown).

The apparatus also includes two spreader means 8 for moving the slings 1 away from each other in at least one substantially horizontal plane, and their function will be better understood from reading the description below of the method of the invention. The spreader means 8 are constituted in the example shown by two pulleys co-operating with the slings and each fixed to one of the ends of a heavy beam 11 extending substantially in a horizontal plane. Each pulley 8 is preferably associated with a downstream counter pulley 12 and with an upstream counter pulley 13 in order to ensure that the slings co-operate properly with the pulleys 8.

The beam 11 is carried by a superposed frame 14 by means of at least two spaced-apart rods 15 fixed to the beam and intended to be guided in vertical sliding by bearings 16 fixed on the frame 14. The free end portions of the rods 15 are provided with abutments 17 suitable for co-operating with the transverse faces of the bearings in order to limit downwards sliding of the beam 11.

Figure 3:
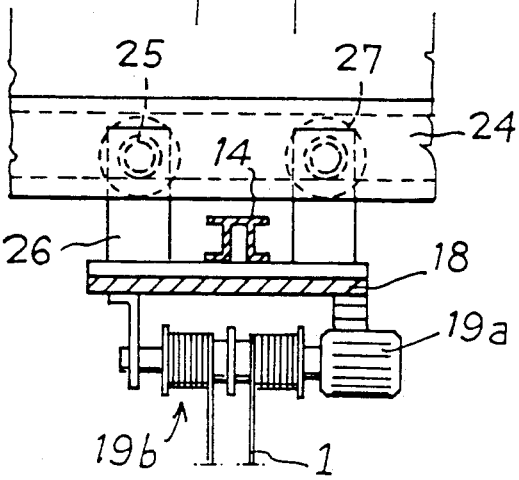
FIG. 3 is a section view taken substantially on line III—III of FIG. 1.

The frame 14 is constituted in the form of a bar and has a fixing plate 18 disposed substantially in the middle thereof for at least one controlled motor unit 19 acting on at least one, and preferably on both slings 1. As can be seen more clearly in FIG. 3, the controlled motor unit 19 is preferably constituted by a motor 19*a* rotating a pair of drums 19*b*, with the opposite ends of the slings to those carrying the pincers being fixed to the drums. Advantageously, the slings 1 are mounted on the drums 19*b* so that both slings are wound in or paid out simultaneously depending on the direction of rotation of the motor 19*a*.

The frame 14 is preferably fitted with two deflector pulleys 21 mounted at opposite ends of the frame each, co-operating with one of the slings. The frame 14 carries two levers 22 each hinged to the frame close to a corresponding one of the pulleys 21. The free end of each lever 22 is fitted with a small wheel 23 which co-operates with a corresponding one of the slings to put the sling under tension.

The frame 14 may be suspended from a rail 24, for example, by means of running wheels 25 carried by extensions 26 from the plate 18. At least one of the wheels 25 is driven by a motor 27 for moving the apparatus along the running rail 24. In order to ensure that the apparatus remains stable during its displacement, the frame 14 is provided with wheels 28 which co-operate with a supporting structure 29 carrying the rail 24 and fitted to a ceiling 30.

Figure 4:
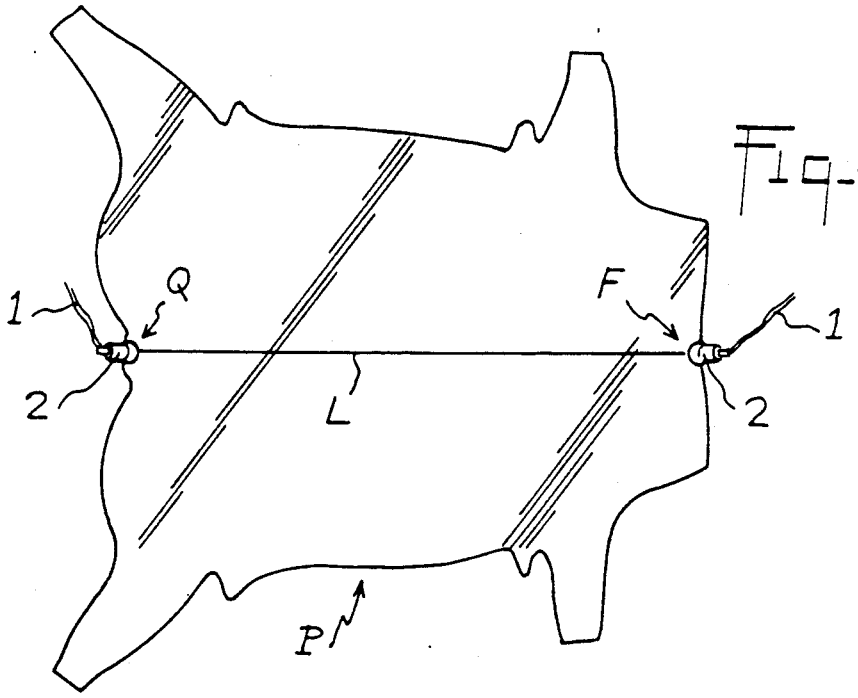
FIG. 4 is a plan view of a skin or hide suitable for being handled by the apparatus of the invention.

The apparatus described above enables the method of the invention for handling a skin or hide P to be implemented, said skin having a line L of greater thickness along its back corresponding to the portion of the skin that initially covered the spinal column of the animal, and as shown in FIG. 4. The ends of the line L of greater thickness are delimited by a tail end Q and a front end F, with tail and front being relative to the corresponding regions of the animal body that was initially covered by the skin.

The method of the invention consists in engaging the pincers 2 on the front and tail portions F and Q of the skin or hide P that is to be handled. Although the skin or hide P is shown fully spread out flat in FIG. 4, it should be understood that the method of the invention can be used on skins or hides presented in various different ways, and in particular in bulk, folded, and/or superposed either regularly or otherwise.

Figure 5A:
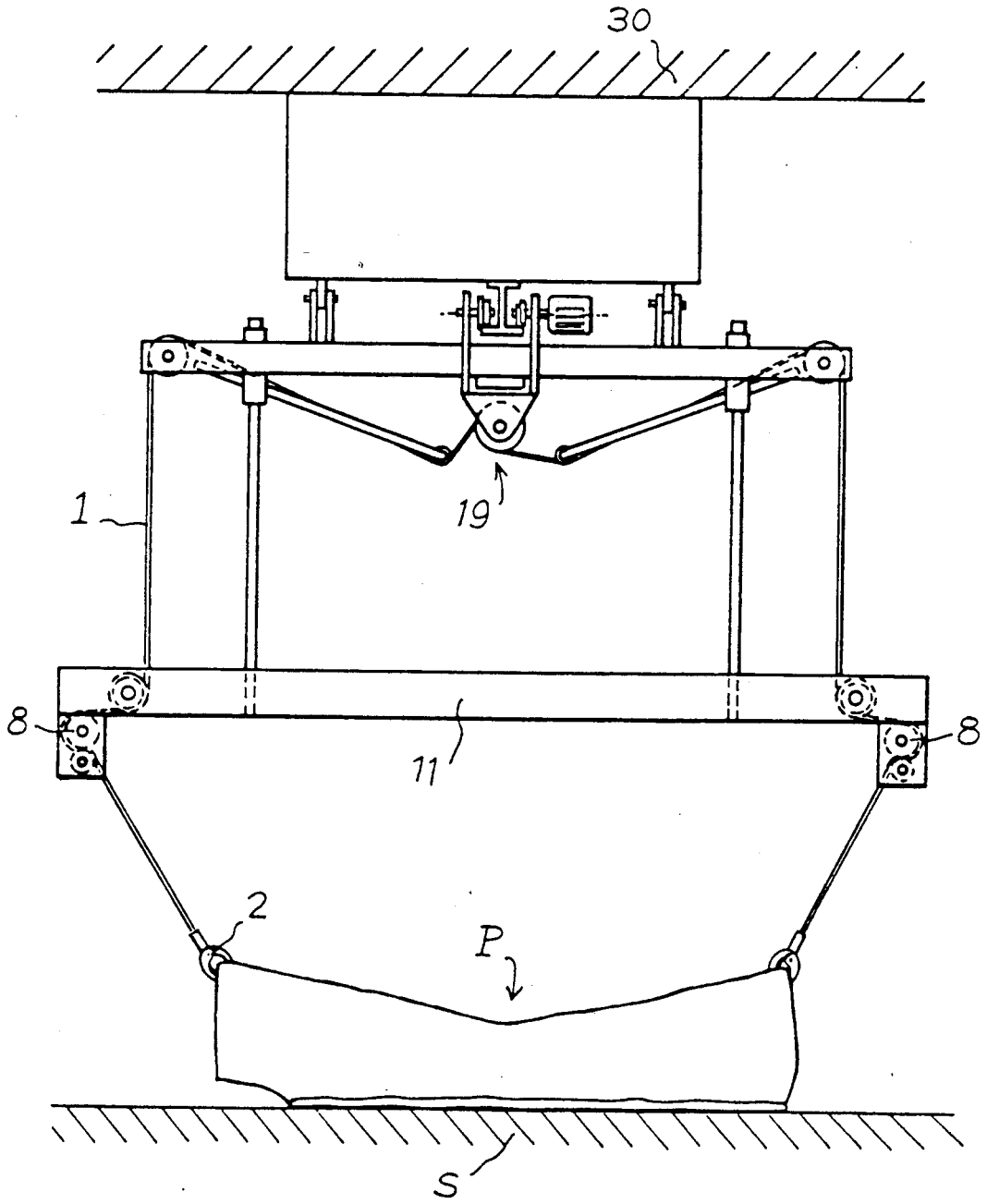
FIGS. 5A to 5C are elevation view of the handling apparatus in various characteristic handling stages.
Figure 5B:
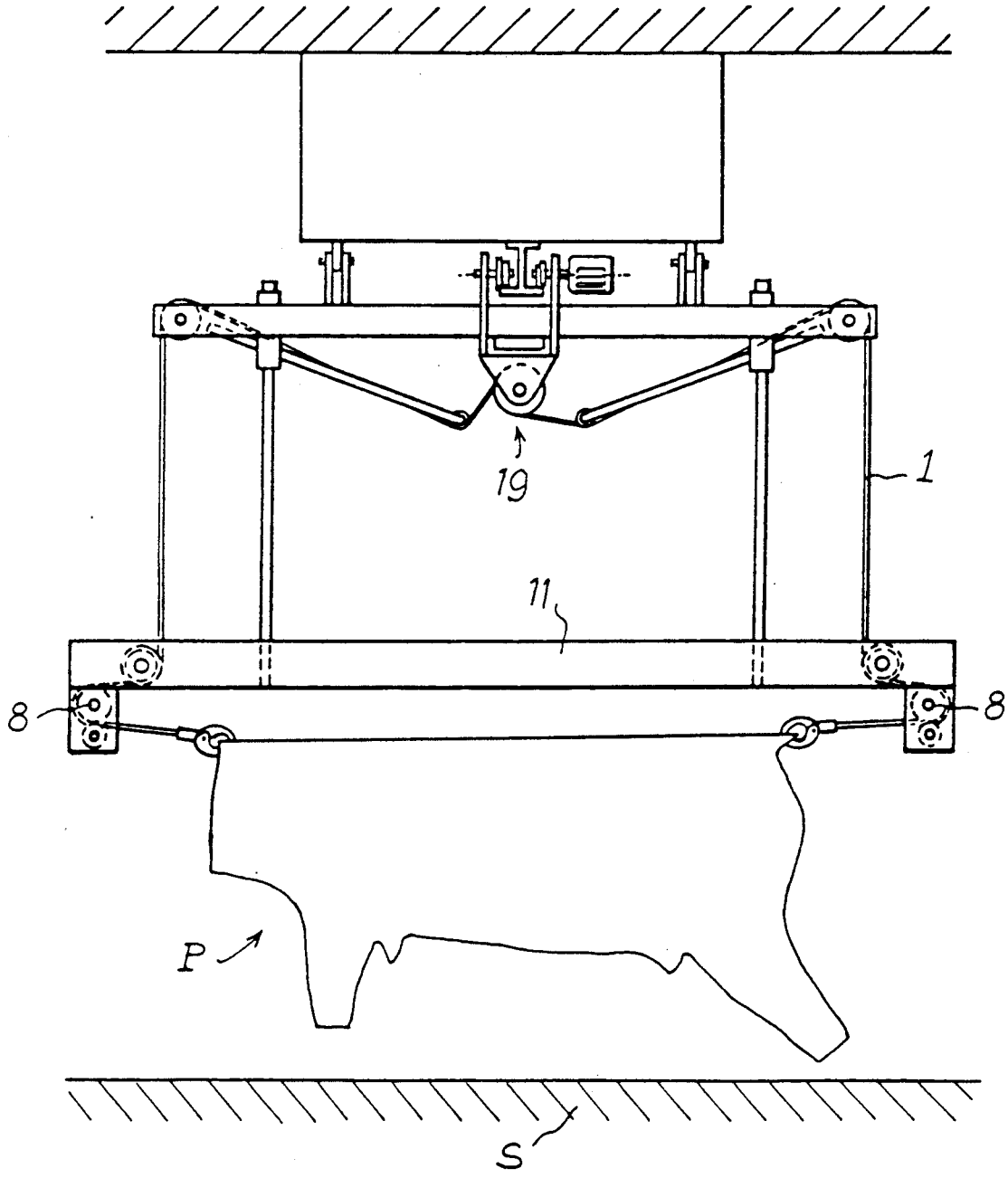

The pincers 2 have their jaws 3 and 4 engaged about the front and tail portions F and Q of the skin or hide in order to hold skins or hides by gripping them firmly. The motor 19*a* is then controlled to wind the slings 1 onto the set of drums 19*b*. As a result, the pincers 2 move away from each other and exert tension on the skin or hide lengthwise along its line L of greater thickness, while simultaneously lifting the skin or hide vertically, thereby folding it naturally under the effect of its own weight about the line L (FIGS. 5A, 5B). The skin or hide P is thus held taut and folded in two portions freely suspended beneath the beam 11 and between the pulleys 8.

Naturally it should be understood that the pulleys 8 are at a distance apart from each other which is greater than the length of the skins to be handled, so as to enable skins or hides of various different sizes to be suspended between the pulleys 8. In this respect, it would be possible to use spreader means of a type different from the means 8, and at least one of the spreader means 8 could be displaceable in a substantially horizontal plane either directly or indirectly by a motor serving to perform the same function, i.e. to move the pincers apart so as to put the skin or hide under tension.

Figure 5C:
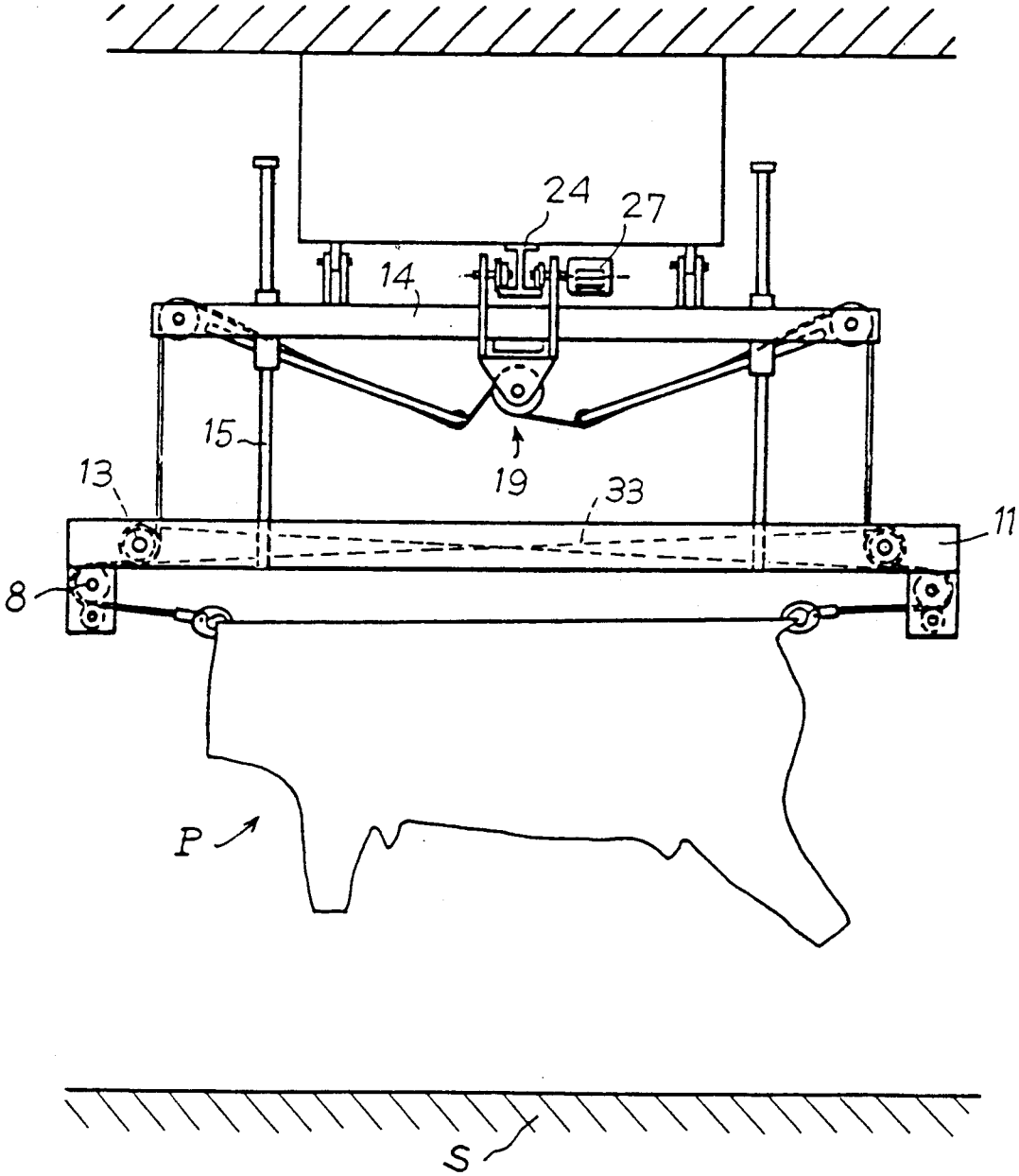

When the tension in the skin or hide reaches a value considered as a maximum value and corresponding to a limiting amount of stretching of the skin or hide, continuing to wind in the slings 1 causes the beam 11 to be raised in a vertical plane (FIG. 5C). The motor 19*a* is stopped in order to position the skin or hide at a selected height above the ground F depending on the obstacles to be passed over during subsequent displacement as described in greater detail below.

Figure 6:
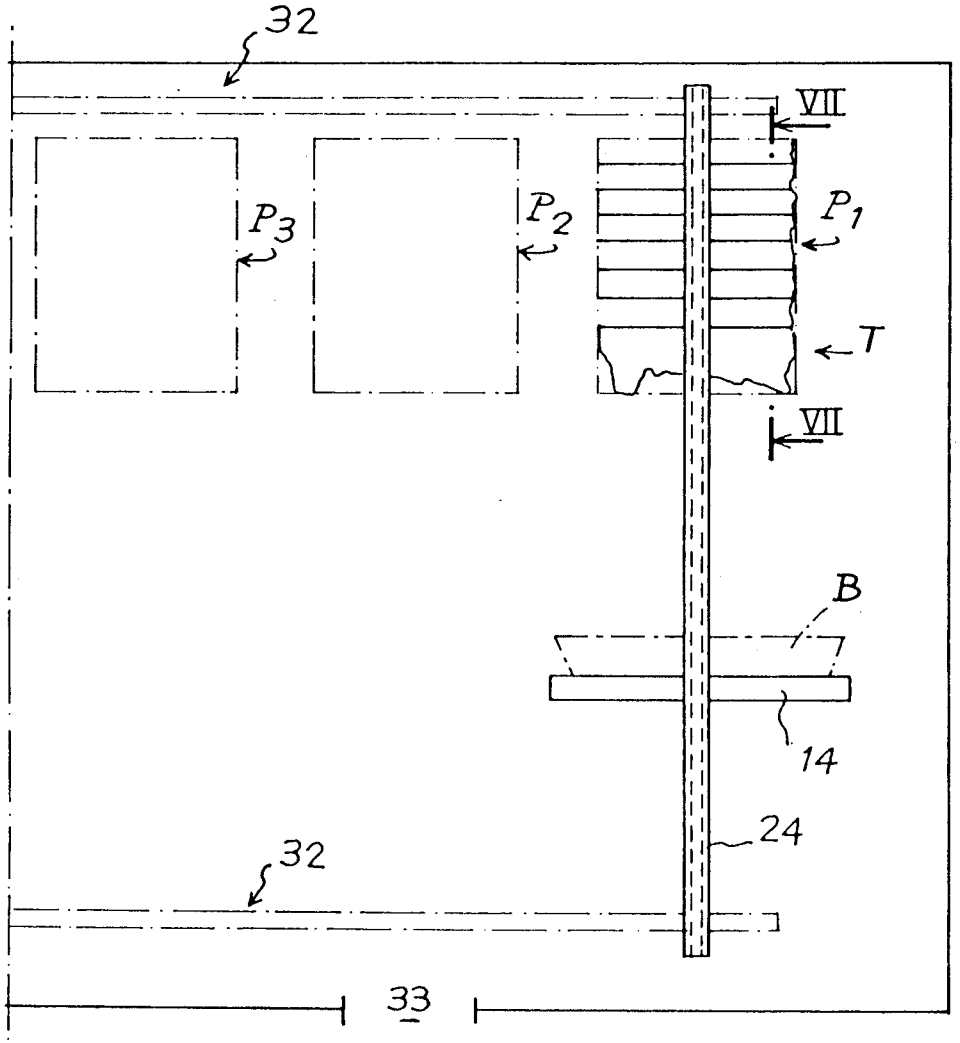
FIG. 6 is a diagrammatic plan view showing an example of how the apparatus of the invention may be applied.

To this end, the motor 27 is caused to rotate in order to displace the frame 14 along the rail 24 until it reaches a determined workstation T (FIG. 6). The motor 19*a* is then controlled to rotate so as to pay out the slings 1 such that the beam 11 moves downwards until the abutments 17 engage the transverse faces of the bearings 16. The slings continue to move down until the motor 19*a* is stopped, which is done when the skin or hide is laid out flat, in a folded position on a skin-receiving plane at the workstation, e.g. on the ground. After the pincers 2 have been disengaged from the skin or hide, the motor 27 may be controlled to bring the apparatus to its initial position and begin a new handling cycle.

The apparatus described above makes it possible to implement a new method of salting raw skins in a stack, consisting in causing the skins to be folded along the back line of greater thickness L when hoisted so that the flesh side is on the outside and the hair sides of the two halves of the skin come into contact with each other. This type of folding can easily be obtained by placing the skins hair side down and flesh side facing the beam 11 prior to engaging the pincers thereon.

While the skin is being moved in a suspended position, the flesh side of the raw skin can be cooled naturally or by forced cooling and residues of flesh and fat can be cleaned off as can numerous blood vessels. The cleaning and/or cooling of the skin may be performed, for example, by subjecting the skin to jets of water. The time during which the skin is displaced after cleaning is preferably chosen to enable the water to flow off naturally so that the skin reaching the workstation has drip-dried. Naturally, a forced drying station could be incorporated between the cleaning station and the workstation.

Figure 7:
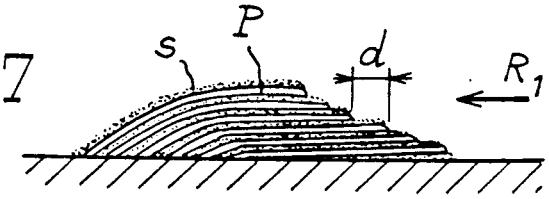
FIG. 7 is a side view seen looking along VII—VII of FIG. 6.

Advantageously, the skin-receiving plane at the workstation is salted prior to the first skin being deposited thereon and salting is performed again on the flesh side of the skin after it has been put into place thereon. Thus, the apparatus may be controlled to bring successive other skins successively into place and lay them onto the previously salted and laid-out skins. This appears more clearly in FIG. 7 showing the skins being preferably placed so that they overlap partially to constitute a row $R_1$ formed by a series of skins P with respective layers of salt s deposited between each pair of skins. It should be observed that the skins can be salted automatically by a machine provided with a salt storage vat (FIG. 6) and mounted on the beam 11, for example, and controlled to deliver a determined quantity of salt onto the skin previously laid out flat.

The skins are preferably offset from each other through a distance d lying in the range 10 cm to 50 cm. In addition, an upper row may be superposed on the row $R_1$, and so on in order to constitute a stack $P_1$ in which skins are stored and allowed to dehydrate.

The method of storing skins which are cleaned, folded, and placed flesh against flesh serves to limit the contact of salt with the hair side, thereby avoiding major conservation defects.

In a preferred embodiment, the rail 24 may be provided with running means at its ends for co-operating with an overhead track 32 extending, for example, in a direction perpendicular to the direction of the rail so as to enable stacks of skins $P_2, P_3, \ldots, P_n$, to be piled up side-by-side.

Advantageously, such an apparatus may be provided in a slaughterhouse for handling fresh skins coming from the slaughtering line, via a feed chute 33.

Naturally, it should be understood that the apparatus is controlled via a circuit serving to control the motor for winding in and paying out the slings and the motor for displacing the apparatus along the rail and along the overhead track. The control circuit is associated, in particular, with sensors (not shown) for sensing the end and the beginning of each stroke, and proximity sensors for detecting the distance between the reception plane and the beam. The circuit may be of the programmable type so as to control the apparatus automatically throughout its cycle of piling up and managing the stacks.

It turns out that the implementation of this apparatus is particularly advantageous in salting and storing skins insofar as the apparatus eliminates, in particular, the main difficulties to which handling personnel are otherwise subjected. With the apparatus, handling personnel merely have to put the pincers into place on the front and tail portions of the skins, and possibly remove them later on. Further, the apparatus serves to make up stacks organized in rows which overlap perfectly insofar as the skins or hides are always positioned at the same location between the pulleys 8. In order to synchronize the motion of these pulleys, the two pulley wheels 13 may be interconnected by a crossed belt 33 (see FIG. 5C).

The apparatus described above is also particularly advantageous when applied to the technique of cropping, i.e. cutting up previously salted skins which are normally stored in stacks.

The apparatus is particularly suitable for moving skins from a storage stack to a reception plane constituted by a cutting table. The way the skins are hung during displacement enables salt to be removed from the skins by gravity. Advantageously, in this technique, the skins are folded along the line of greater back thickness so that the hair side is on the outside, thereby facilitating proper cropping. Thus, the skins are placed flat and folded accurately along the line of greater thickness, thereby making it possible to cut up the various portions of the skin accurately and thus making it possible to obtain portions of skin which are uniform in structure.

Naturally, the apparatus of the invention may be implemented for performing various manipulations that take place during the various transformation operations to which raw skins are subjected in leathermaking.

The invention is not limited to the examples described and shown, since numerous modifications may be made thereto without going beyond the scope of the invention.

I claim:

1. A method of handling skins or hides having a central line of increased thickness along the back between a tail end portion and a front end portion, the method being of the type consisting in displacing the skin or hide to a workstation by means of two clamping pincers on a handling apparatus, the method comprising the following steps:

engaging the pincers on the tail and front portions of a skin or hide;

moving the pincers away from each other in order to put the skin or hide under tension along the back line of increased thickness;

raising the skin or hide so as to allow it to fold along said back line of increased thickness while hanging freely;

displacing the skin or hide to the workstation while the skin or hide is hanging in the folded position;

laying the folded skin or hide out flat under tension on a reception plane at the workstation; and releasing the pincers from the tail and front portions of the skin or hide.

2. A method according to claim 1, wherein the folding of the skin or hide along the back line of increased thickness is carried out with the flesh side placed on the outside.

3. A method according to claim 2, including subjecting the flesh side of the suspended skin or hide to cooling while it is being displaced.

4. A method according to claim 3, wherein the cooling is carried out by subjecting the skin or hide to jets of water, and including displacing the suspended skin or hide for a sufficient length of time to allow it to drip-dry or dry completely after being subjected to the jets of water.

5. A method according to claim 1, including salting the reception plane prior to placing the skin or hide on the plane.

6. A method according to claim 1, including laying each skin or hide out flat and partially overlapping the previously laid-out and salted skin or hide, thereby building up a raw.

7. A method according to claim 6, including laying out the skins or hides on a row of skins or hides that has already been formed, thereby building up a stack.

8. A method according to claim 1, wherein the folding of the skin or hide along the back line of increased thickness is carried out with the hair side placed on the outside.

9. A method according to claim 2, including subjecting the flesh side of the suspended skin or hide to cleaning while it is being displaced.

10. A method according to claim 9, wherein the cleaning is carried out by subjecting the skin or hide to jets of water, and including displacing the suspended skin or hide for a sufficient length of time to allow it to drip-dry or dry completely after being subjected to the jets of water.

11. Apparatus for implementing the method of handling skins or hides according to claim 1, the apparatus being of the type comprising two slings each fitted with a pincer for clamping across the thickness of a skin or hide, two spreader means for spreading the slings apart from each other in at least one substantially horizontally plane, and at least one motor unit acting on at least one of the slings in order to cause the pincers to move apart relative to each other;

wherein the spreader means are suitable for being spread apart from each other by a distance which is not less than the length of a skin or hide, thereby enabling the skin or hide clamped between the pincers to be folded and suspended along its back line of increased thickness, and wherein the motor unit is controlled to ensure that the pincers are spread apart by at least the length of a skin or hide, thereby enabling the skin or hide to be put under tension along its back line of increased thickness.

12. Apparatus according to claim 11, wherein the two spreader means each comprise a pulley co-operating with one of the slings and fitted to the end of a heavy beam extending in a horizontal plane.

13. Apparatus according to claim 11, wherein the motor unit comprises a motor drum on which the slings are wound so to be wound in or paid out simultaneously, thereby raising or lowering the beam which holds the skin or hide in the suspended position.

14. Apparatus according to claim 13, wherein the motor drum is fixed to a suspended frame including bearings for guiding in vertical sliding motion rods carried by the beam.

15. Apparatus according to claim 14, wherein the frame includes a pulley at each end co-operating with a respective one of the slings, together with a tensioning lever for each of the slings.

16. Apparatus according to claim 14, wherein the frame is suspended from at least one running rail and includes a motor for displacing the frame along the rail.

17. Apparatus according to claim 16, wherein the running rail is itself displaceable along a guide track in a direction extending transversely to the rail direction.

* * * * *